US005118396A

United States Patent [19]

Claus et al.

[11] Patent Number: 5,118,396

[45] Date of Patent: Jun. 2, 1992

[54] ELECTROLYTIC PROCESS FOR PRODUCING NEODYMIUM METAL OR NEODYMIUM METAL ALLOYS

[75] Inventors: Kenneth G. Claus; Dwaine W. Schoppe; Matthew R. Earlam, all of Lake Jackson, Tex.

[73] Assignee: The Dow Chemical Company, Midland, Mich.

[21] Appl. No.: 364,769

[22] Filed: Jun. 9, 1989

[51] Int. Cl.[5] ..... C25C 3/00

[52] U.S. Cl. ..... 204/64 R; 204/71

[58] Field of Search ..... 204/64 R, 71

[56] References Cited

U.S. PATENT DOCUMENTS

| | | | |
|---|---|---|---|
| 2,961,387 | 11/1960 | Slatin | 204/64 R |
| 3,729.397 | 9/1970 | Goldsmith et al. | 204/64 R |
| 4,002,502 | 1/1977 | Bainbridge et al. | 148/437 |
| 4,828.658 | 5/1989 | Bertaud | 204/71 |
| 4,853,094 | 8/1989 | Horders et al. | 204/64 R |

OTHER PUBLICATIONS

Morrice et al., *Fused-Salt Electrowinning and Electrorefining of Rare-Earth and Yttrium Metals.* Minerals Science Engineering, vol. 11, No. 3, Jul. 1979.

*Primary Examiner*—John F. Niebling
*Assistant Examiner*—David G. Ryser

[57] ABSTRACT

A process based on molten salt electrolysis for producing pure rare earth metals is disclosed. This process is the direct electrolytic deposition of a rare earth metal such as neodymium, from a molten salt cell containing a mixture of electrolytes and a salt of neodymium, onto a liquid magnesium cathode forming an intermediate alloy. The intermediate alloy is distilled to isolate the neodymium metal. Also disclosed is a process for producing a pure neodymium/iron alloy wherein pure iron is added to the intermediate neodymium/magnesium alloy during the distillation step.

10 Claims, 2 Drawing Sheets

ELECTROLYTIC PROCESS FOR PRODUCING NEODYMIUM METAL OR NEODYMIUM METAL ALLOYS

BACKGROUND OF THE INVENTION

This invention relates to a process for preparing neodymium metal or neodymium metal alloys which can be advantageously used in processes for producing neodymium based permanent magnets.

Heretofore, no highly efficient method has been available for the formation of magnesium based rare earth alloys. A paper, Compt. rend., 217, 603, 1943, describes a metallothermic reduction of rare earth chlorides with magnesium, but produces products with rare earth concentrations in the area of 10 weight percent, making any further purification much more difficult.

Another prior art process described in Compt. rend., 220, 778, 1945, uses a liquid magnesium-cadmium cathode to make ternary alloys of rare earth-magnesium-cadmium. This results in having to remove two metals to obtain a pure rare earth metal, and prevents the recovery of pure magnesium. It also limits the cell construction to a bottom tapping cell.

Another prior art process described in *Revue Chim. Miner*, Vol. 10, 1973, pp 347–353, uses a molten pool cathode to make rare earth metals, but in this process a fluoride based system is used and oxide or fluoride salts are used for feed. The cell of this prior art process operates at higher temperatures such as 1000° C. and has the environmental and health problems associated with fluorides.

One method in the present art for the preparation of neodymium metal or neodymium/iron alloy includes molten salt electrolysis of neodymium salts which operates either at low current efficiencies or involves the use of molten fluorides, which presents handling and safety problems.

Another method known in the prior art includes metallothermic reduction of neodymium salts, which involves the use of metallic calcium as the reducing agent and creates large volumes of slag for disposal.

It is desired to provide a method which uses much safer reactants, is operated as an entirely closed system, and provides no slag for disposal. It is also desired to provide a process which produces a pure magnesium as a by-product which is also a marketable product. It is further desired to provide an electrolytic process which overcomes the problem of the solubility of the product metal in the electrolyte of such process. A product which dissolves in the electrolyte is easily rechlorinated, causing low current efficiencies. By depositing the product metal into a second metal, the product is not soluble, and higher efficiencies are obtained.

SUMMARY OF THE INVENTION

One aspect of the present invention is a process for preparing a rare earth/magnesium alloy comprising electrolytically depositing a rare earth metal from a molten salt cell containing a chloride salt mixture as an electrolyte, such as potassium chloride and calcium chloride, and a chloride salt of the rare earth metal into a liquid magnesium cathode.

Another aspect of the present invention is a process for preparing rare earth metals comprising electrolytically depositing a rare earth metal from a molten salt cell containing a chloride salt mixture as an electrolyte and a chloride salt of the rare earth metal into a liquid magnesium cathode to form a rare earth/magnesium alloy and then distilling the rare earth/magnesium alloy to isolate the pure rare earth metal and magnesium metal.

Still another aspect of the present invention is a process for preparing a neodymium/iron alloy comprising forming a neodymium/magnesium alloy by electrolytically depositing neodymium metal from a molten salt cell containing a mixture of an electrolyte and a salt of the neodymium metal onto a liquid magnesium cathode and adding iron to the intermediate neodymium/magnesium alloy during distillation of the neodymium/magnesium alloy to produce a neodymium/iron alloy.

The neodymium metal or neodymium/iron alloys are useful for making neodymium based permanent magnets.

The process of the present invention is also a general method for the preparation of any metal which will form an alloy with a volatile metal such as magnesium.

DETAILED DESCRIPTION OF THE PREFERRED EMBODIMENT(S)

Figure 1:
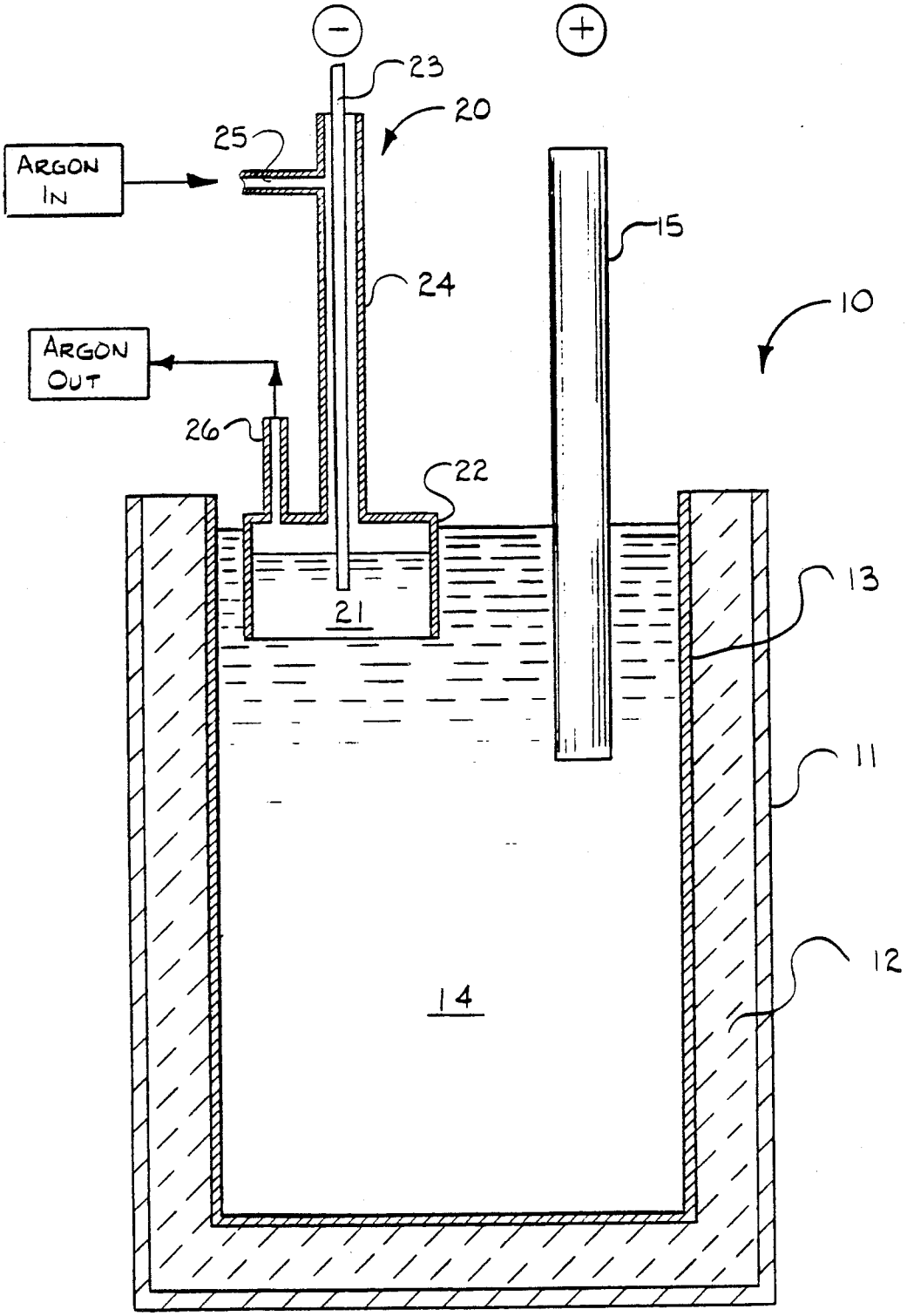
FIG. 1 is a schematic view showing a molten cell having a liquid cathode therein.

With reference to FIG. 1, an electrochemical cell represented generally by the numeral 10 is shown with a cell containment structure 11 with a heat-insulating layer 12 and an inner container layer 13 containing a volume of molten electrolyte 14, a positive electrode 15, and a negative electrode, generally indicated by numeral 20. The containment structure 11 can be of any conventional material for holding molten salt baths of the present invention. For example, rigid high temperature insulation brick, or steel or rigid insulating fiberboard can be used for the containment structure 11. The cell's refractory heat-insulating layer 12 can be made of, for example, brick and high temperature fiber board. The inner layer 13 is resistant to the attack of the bath 14 and is made of, for example, fused quartz, steel, tantalum, ceramics and various other known refractories.

The positive electrode (anode) 15 is of conventional type and may include graphite and any conductive material which is stable to chlorine gas concentrations and high temperatures such as above about 400 degrees C. and below about 1100 degrees C. The anode may be used in a variety of shapes such as a rod form, a plate form, a pipe form, a fluted form and the like.

The negative electrode (cathode) 20 is a molten cathode. The metal for the cathode is preferably added to the cell as ingots. The metal is preferably magnesium, aluminum, magnesium alloys or aluminum alloys. The cathode magnesium metal ingots are melted and the molten magnesium cathode 21 is contained in a suitable container 22, such as quartz or other materials such as alumina or spinel, magnesia, or any other nonconductive (electrically) material stable at high temperatures and in high chlorine and chloride concentrations. The container 22 is preferably a cylindrical sleeve containing cathode 21.

Any conductive metal or ceramic may be used for an electrical connection to the molten cathode. The electrical connection is made to the molten cathode, for example, by a solid magnesium rod 23 enclosed in an alumina tube 24 positioned above and integral with the container 22. The magnesium rod 23 is preferably cooled by an inert gas such as argon which passes through an inlet tube 25 into the tube 24 and exits the tube 24 at outlet tube 26. Any material which is nonreactive with the product alloy material can be used for the cathode sleeve 24. For example, alumina and magnesia may be used for the cathode sleeve 24. The containers 22 an 24 may be one continuous piece and made of the same materials or may be two separate pieces of different materials.

Broadly speaking, the process of the present invention includes electrolytically depositing a neodymium metal component of desired alloy directly into the molten magnesium cathode from a molten salt bath containing the chloride salt of the neodymium metal to form a neodymium/magnesium product alloy.

The molten electrolyte or fused salt bath 14 can be one salt or a mixture of salts. For example, the salts may include alkali, alkaline earth and/or lanthanide chlorides and/or fluorides. The composition of the bath may include from about 1 to about 30% by weight of NaCl; from about 20 to about 80% by weight of $CaCl_2$; from about 30 to about 60 wt. percent of KCl; 0 to about 20 wt % $CaF_2$ and 0 to about 50 wt % NaCl.

Other chloride salts of more negative reduction potentials can also be present in the bath. For example, KCl, LiCl, $CaCl_2$, $BaCl_2$ and $SrCl_2$.

Carrying out one embodiment of the process of the present invention generally involves first melting an electrolyte 14 in an electrochemical cell structure 10 at a temperature of from about 650 to about 850 degrees C. The cell temperature should be at a temperature to maintain the electrolyte in a molten condition. The cell 10 is operated at a temperature between about 650 to about 850 degrees C. because at temperatures lower than 650° C. the electrolyte and liquid cathode may freeze and higher than 850° C. the electrolyte may begin to evaporate. Preferably, the process is carried out at a temperature of from about 680° C. to about 750° C.

After a dry anode 15 is inserted into the molten electrolyte as is well known in the art, the liquid magnesium cathode 21 is prepared by adding a magnesium cathode material to the container 22 and by melting the cathode material in the container 22. The temperature of the cell should already be at the temperatures aforementioned sufficient to melt the magnesium, i.e., the melting of magnesium metal is carried out between 650 and 850 degrees C. The molten cathode floats on the surface of the electrolyte.

An electrical element is connected to the molten magnesium. Electrical contact is made between the two electrodes and current is passed through the cell at a current density of about 0.1 to about 50 amps per square inch for enough ampere-hours to make the desired alloy composition. For example, to make an alloy of 70 weight % magnesium and 30 weight % neodymium, one would start with a molten cathode of 700 grams of magnesium as the liquid cathode, and electrodeposit neodymium from a neodymium chloride containing electrolyte for a period of 167 ampere hours. This would result in the liquid pool cathode containing 700 grams of magnesium and 300 grams of neodymium.

The neodymium metal from the molten salt bath is electrically deposited into the molten magnesium cathode to form an alloy of a neodymium metal and magnesium in the container 22. The current is then turned off and the product is removed from the container 22.

The molten neodymium/magnesium alloy collected at the cathode in the sleeve can be removed by any mechanical means known in the art such as dipping, pumping, or bottom tapping. The neodymium/magnesium alloy which is removed from the cathode tube may then be cooled by free convection in ambient air or in a controlled atmosphere or passed to a use point in a molten state.

The resulting neodymium/magnesium product generally contains from about 0.1 to about 90 weight percent of the neodymium metal, with the neodymium content being somewhat dependent on the desired temperature of cell operation. For example, if a neodymium content above 60 weight percent is desired, the electrolyte temperature must be kept above 775° C., or the liquid cathode will solidify, as the phase diagram for magnesium-neodymium shows the formation of a solid phase above 775° C. and 60 weight % neodymium. Going to higher temperatures will cause increased evaporation of the chloride electrolyte. It is preferred to have a neodymium content of from about 20 to about 40 weight percent.

The product is generally a brittle, shiny metallic alloy which is stable in air. The products may be used as in the production of neodymium/iron/boron permanent magnets and any neodymium alloy such as Nd-Mg alloys.

Figure 2:
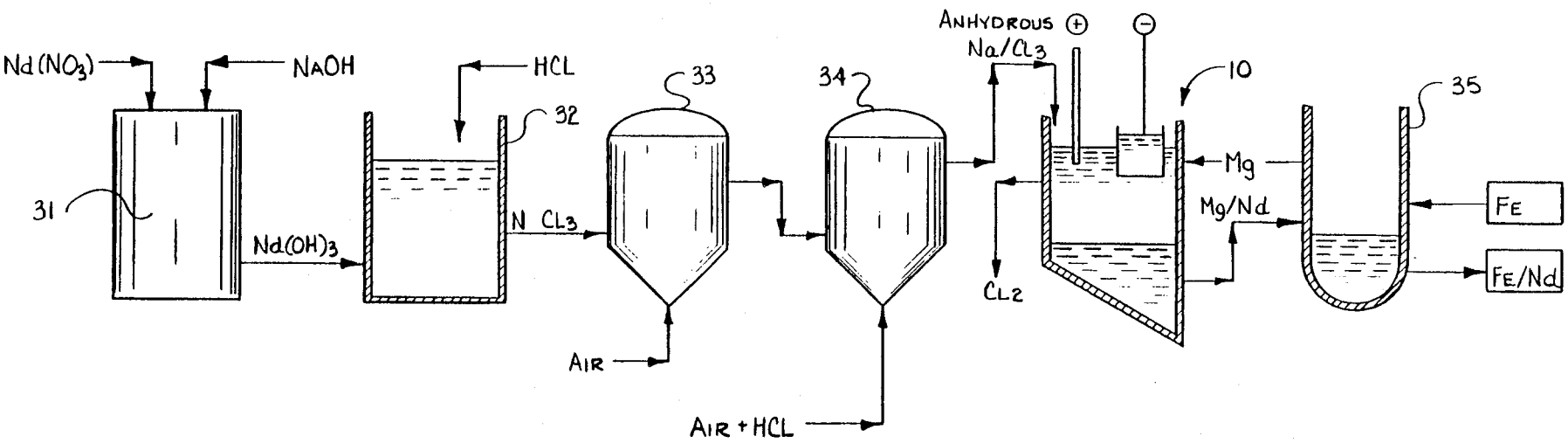
FIG. 2 is a schematic flow diagram showing a molten salt electrolysis process using the molten cell of FIG. 1.

With reference to FIG. 2, there is shown one embodiment of the process of the present invention including a cell generally indicated at numeral 10 (FIG. 1). In this process, a neodymium chloride is produced by mixing a neodymium nitrate and sodium hydroxide in a vessel 31 to form a neodymium hydroxide and then reacting the neodymium hydroxide with hydrochloric acid in a vessel 32 to form a neodymium chloride. The neodymium chloride is then dried with air and a mixture of air and HCl in vessels 33 and 34 respectively. Anhydrous neodymium chloride from vessel 34 is fed into the cell 10 and is electrolyzed to form a magnesium/neodymium alloy which is fed to a distillation vessel 35 wherein the magnesium is distilled for further use in cell 10 or may be transferred to another use point. As shown in FIG. 2, iron is preferably added to the distillation vessel 35 to form a neodymium/iron alloy which can be used for producing neodymium based permanent magnets. In another embodiment, the iron may be added to cell 10.

In another embodiment, a neodymium product is obtained from the distillation step without the addition of iron (not shown) and can also be used for producing neodymium based permanent magnets.

EXAMPLE 1

A three liter quartz beaker is placed in a furnace capable of heating the beaker to at least 800° C. The beaker is filled with a salt mixture consisting of 1200 grams of $CaCl_2$, 1200 grams of KCl, and 600 grams of anhydrous $NdCl_3$. The cell is heated to a temperature of 750° C. and the cell fitted with an anode and a cathode. The anode is a graphite rod, whereas the cathode is a pool of molten magnesium weighing 7.19 grams and contained inside a fused quartz cylinder. A solid magnesium rod is used to connect the molten pool of magnesium with the power supply, and an argon blanket is kept over the cathode lead to prevent oxidation. The cell is operated at 6.0 amps for 30 minutes, or a total of 3.0 amp hours. Part way through the electrolysis, the cathode pool becomes more dense than the electrolyte, and begins to sink. The fused quartz cylinder is then lowered into the bath to maintain the integrity of the cathode. At the end of the electrolysis, the cathode pool is removed. The resulting metal alloy weighed 11.90 grams and had a neodymium content of 37.4%, for a current yield of 82.9%. A neodymium metal from the neodymium/magnesium alloy is obtained by distilling off the magnesium using well known technology.

EXAMPLE 2

The procedure of Example 1 is followed to obtain a neodymium/magnesium alloy.

Then, pure iron is added to the alloy during the distillation step to form a 11% iron, 89% neodymium alloy. When iron is added to this extent, the product remaining after distillation is in liquid form, thereby facilitating the removal of the final product.

EXAMPLE 3

A 500 ml fused quartz beaker is placed in a furnace capable of heating the beaker to at least 800° C. The beaker is filled with a salt mixture consisting of 200 grams KCl, 200 grams NaCl, and 100 grams $CeCl_3$. The cell is heated to a temperature of 720° C. and the cell fitted with an anode and cathode. The anode is a graphite rod, whereas the cathode is a pool of molten magnesium weighing 2.06 grams and contained inside a fused quartz cylinder with a closed bottom. A steel rod is used to connect the molten pool magnesium with a power supply. The cell is operated at 5.0 amperes for 12 minutes, or a total of 1.0 ampere hours. At the end of the electrolysis the cathode pool is removed. The resulting metal alloy weighed 3.43 grams and had a cerium content of 39.9%, for a current yield of 78.7%. Cerium metal is obtained from the cerium-magnesium alloy by distilling off the magnesium using well known distillation technology.

What is claimed is:

1. A process for preparing a rare earth metal comprising providing a molten salt cell at a temperature in the range between 650° C. and 850° C., said salt cell consisting essentially of at least one chloride salt as an electrolyte and a chloride salt of the rare earth metal and electrolytically depositing the rare earth metal into a liquid magnesium cathode to form a rare earth-/magnesium alloy and thereafter distilling the alloy to isolate the pure rare earth metal and magnesium metal.

2. The process of claim 1 wherein the rare earth metal is neodymium.

3. The process of claim 1 wherein the molten salt cell electrolyte contains a salt selected from potassium chloride, calcium chloride, lithium chloride, sodium chloride, strontium chloride and barium chloride.

4. The process of claim 1 wherein the electrolysis temperature is in the range of about 680° C. to about 750° C.

5. A process for preparing a neodymium/iron alloy comprising providing a molten salt cell at a temperature in the range between 650° C. and 850° C., said salt cell consisting essentially of at least one chloride salt as an electrolyte and a chloride salt of neodymium, elelctrolytically depositing the neodymium into a liquid magnesium cathode thereby forming a neodymium/magnesium alloy and thereafter adding iron to the intermediate neodymium/magnesium alloy during distillation of the neodymium/magnesium alloy to produce a neodymium/iron alloy.

6. The process of claim 5 wherein the molten salt cell electrolyte contains a salt selected from potassium chloride, calcium chloride, lithium chloride, sodium chloride, strontium chloride and barium chloride.

7. The process of claim 5 wherein the electrolysis temperature is in the range of about 680° C. to about 750° C.

8. A process for preparing a neodymium/magnesium alloy comprising providing a molten salt cell at a temperature in the range between 650° C. and 850° C., said salt cell consisting essentially of at least one chloride salt as an electrolyte and a chloride salt of neodymium, electrolytically depositing neodymium metal into a liquid magnesium cathode thereby forming the neodymium/magnesium alloy.

9. The process of claim 8 wherein the molten salt cell electrolyte contains a salt selected from potassium chloride, calcium chloride, lithium chloride, sodium chloride, strontium chloride and barium chloride.

10. The process of claim 8 wherein the electrolysis temperature is in the range of about 680° C. to about 750° C.

* * * * *